US010894409B2

(12) United States Patent
Yamamuro et al.

(10) Patent No.: US 10,894,409 B2
(45) Date of Patent: Jan. 19, 2021

(54) METHOD OF MANUFACTURING A LIQUID EJECTION HEAD

(71) Applicant: CANON KABUSHIKI KAISHA, Tokyo (JP)

(72) Inventors: Jun Yamamuro, Yokohama (JP); Kazuhiro Asai, Kawasaki (JP); Keiji Matsumoto, Fukushima (JP); Kunihito Uohashi, Yokohama (JP); Keiji Watanabe, Kawasaki (JP); Masahisa Watanabe, Yokohama (JP); Tetsushi Ishikawa, Tokyo (JP); Yasuaki Tominaga, Kawasaki (JP); Manabu Otsuka, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 73 days.

(21) Appl. No.: 16/124,511

(22) Filed: Sep. 7, 2018

(65) Prior Publication Data

US 2019/0077156 A1 Mar. 14, 2019

(30) Foreign Application Priority Data

Sep. 13, 2017 (JP) ..... 2017-176014

(51) Int. Cl.
*B41J 2/16* (2006.01)
*B41J 2/14* (2006.01)

(52) U.S. Cl.
CPC ..... *B41J 2/1623* (2013.01); *B41J 2/14145* (2013.01); *B41J 2/1603* (2013.01); (Continued)

(58) Field of Classification Search
CPC ..... B41J 2/1623; B41J 2/1628; B41J 2/1631; B41J 2/1645; B41J 2/14145; B41J 2/1634;
(Continued)

(56) References Cited

U.S. PATENT DOCUMENTS 6,473,966 B1 * 11/2002 Kohno ..... B41J 2/1603 216/23
9,789,690 B2 10/2017 Watanabe et al.
(Continued)

FOREIGN PATENT DOCUMENTS

JP 2003276206 A * 9/2003
JP 2015-104876 A 6/2015

OTHER PUBLICATIONS

JP-2003276206-A Machine translation of Description (EPO/Google) (Year: 2020).*

*Primary Examiner* — Christopher T Schatz
*Assistant Examiner* — Cynthia L Schaller
(74) *Attorney, Agent, or Firm* — Venable LLP

(57) ABSTRACT

Provided is a method of manufacturing a liquid ejection head, which is capable of patterning a dry film while suppressing deformation of the dry film caused by a pressure. The method of manufacturing a liquid ejection head includes: preparing a substrate including an ejection orifice member on a first surface; forming, on an ejection orifice surface of the ejection orifice member, a protection film having communicating holes for allowing ejection orifices to communicate to outside; closing an opening of a supply port on a second surface on a side opposite to the first surface of the substrate with a dry film; and patterning the dry film by irradiating the dry film with light under a state in which the protection film is formed on the ejection orifice surface.

14 Claims, 5 Drawing Sheets

(52) U.S. Cl.
CPC ..... *B41J 2/164* (2013.01); *B41J 2/1606* (2013.01); *B41J 2/1626* (2013.01); *B41J 2/1628* (2013.01); *B41J 2/1629* (2013.01); *B41J 2/1631* (2013.01); *B41J 2/1634* (2013.01); *B41J 2/1639* (2013.01); *B41J 2/1645* (2013.01); *B41J 2002/14467* (2013.01)

(58) Field of Classification Search
CPC ..... B41J 2/1639; B41J 2/1629; B41J 2/1603; B41J 2/1626; B41J 2/164; B41J 2/1606; B41J 2002/14467
See application file for complete search history.

(56) References Cited

U.S. PATENT DOCUMENTS

| | | | | |
|---|---|---|---|---|
| 9,919,526 | B2 | 3/2018 | Asai et al. | |
| 2007/0070122 | A1* | 3/2007 | Bertelsen | B41J 2/1639 347/44 |
| 2012/0055022 | A1* | 3/2012 | Matsumoto | B41J 2/1603 29/890.1 |
| 2017/0036447 | A1 | 2/2017 | Ishikawa et al. | |
| 2018/0154637 | A1 | 6/2018 | Asai et al. | |

* cited by examiner

METHOD OF MANUFACTURING A LIQUID EJECTION HEAD

BACKGROUND OF THE INVENTION

Field of the Invention

The present invention relates to a method of manufacturing a liquid ejection head configured to eject a liquid.

Description of the Related Art

In Japanese Patent Application Laid-Open No. 2015-104876, there is described a method involving performing tenting on a substrate having communicating holes with a dry film supported by a support, peeling the support from the dry film, and patterning the dry film by a photolithography technology, to thereby form a flow path member.

FIG. 1A to FIG. 1D are views for illustrating steps of manufacturing a liquid ejection head in the related art. Description is made of the related-art method of manufacturing a liquid ejection head. As illustrated in FIG. 1A, ejection orifices 13 are formed in a photosensitive resin (ejection orifice member) 9. Next, as illustrated in FIG. 1B, a tape to be a film 20 for protecting an ejection orifice surface 13*a* is bonded to the photosensitive resin (ejection orifice member) 9 having the ejection orifices 13 formed therein. After that, as illustrated in FIG. 1C, tenting is performed on common liquid chambers (supply ports) 15 formed on a reverse surface side of a substrate 4 with a photosensitive dry film resist 17 supported by a support 1. Then, as illustrated in FIG. 1D, the support 1 is peeled from the dry film resist 17. After that, flow path openings (not shown) are formed in the dry film resist 17 by the photolithography technology.

However, each space including the supply port 15 is sealed under a state in which tenting is performed with the dry film resist 17. When a pressure in each space including the supply port 15 is changed to be decreased in this state, and the support 1 is peeled, concave portions are formed on the dry film resist 17 as illustrated in FIG. 1D. Further, when the pressure in each space including the supply port 15 is increased, the dry film resist 17 is deformed to have protrusions. When flow path openings are formed by the photolithography technology under a state in which the concave portions or deformation occurs in the dry film resist 17 as described above, there is a problem in that a desired pattern cannot be formed when a pattern is formed through irradiation with light.

SUMMARY OF THE INVENTION

According to one embodiment of the present invention, there is provided a method of manufacturing a liquid ejection head, the liquid ejection head including a substrate and an ejection orifice member, which is formed on a first surface of the substrate, and has an ejection orifice surface having formed therein ejection orifices, the method including: preparing the substrate including, on the first surface, the ejection orifice member having the ejection orifice surface having formed therein the ejection orifices, and a supply port opened on a second surface on a side opposite to the first surface of the substrate, the ejection orifices and the supply port communicating to each other in the substrate; forming, on the ejection orifice surface, a film having communicating holes for allowing the ejection orifices to communicate to outside; closing an opening of the supply port on the second surface with a dry film; and patterning the dry film by irradiating the dry film with light under a state in which the film having the communicating holes is formed on the ejection orifice surface.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An object of the present invention is to provide a method of manufacturing a liquid ejection head capable of patterning a dry film (resist) while suppressing deformation of the dry film (resist) caused by a pressure.

First Embodiment

Now, a first embodiment of the present invention is described with reference to the drawings.

FIG. 2A to FIG. 2G are views for illustrating steps of manufacturing a substrate to be used in a liquid ejection head according to the first embodiment.

Now, a method of manufacturing a substrate is described in the order of steps with reference to FIG. 2A to FIG. 2G.

Figure 1A:
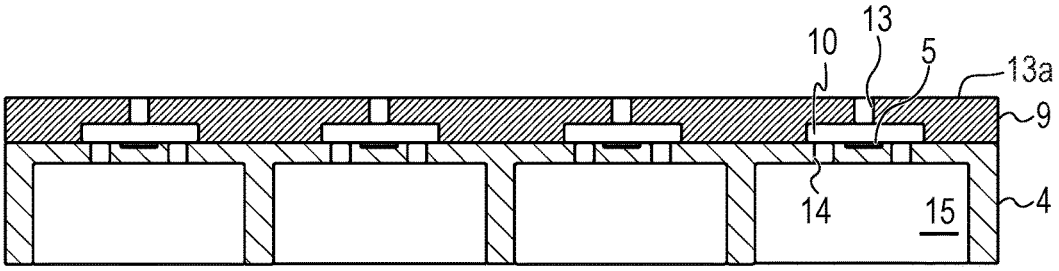
FIG. 1A is a view for illustrating a step of manufacturing a liquid ejection head in the related art.
Figure 1B:
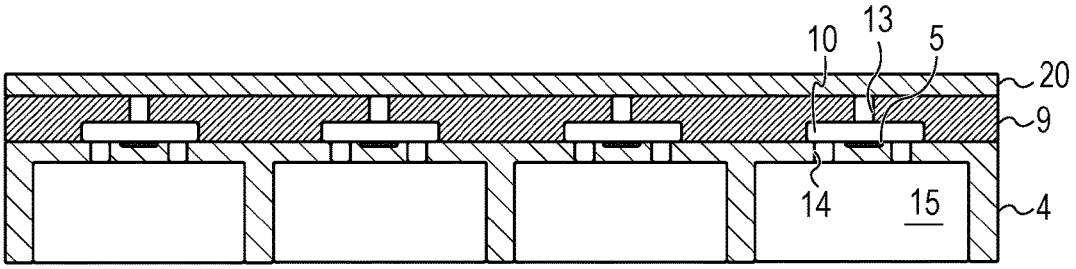
FIG. 1B is a view for illustrating a step of manufacturing a liquid ejection head in the related art.
Figure 1C:
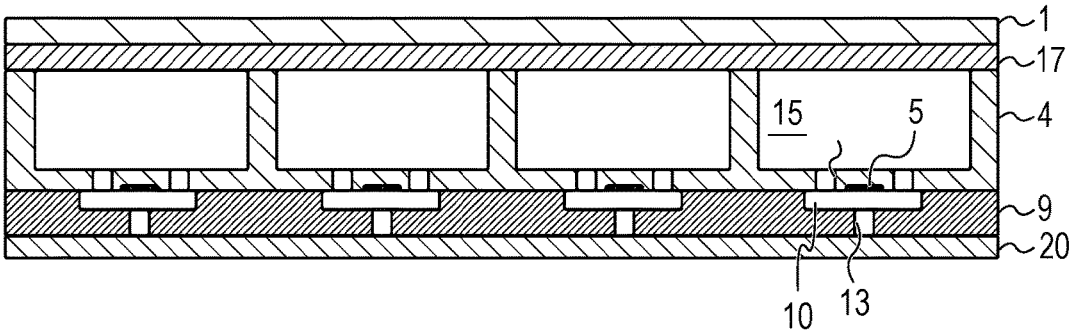
FIG. 1C is a view for illustrating a step of manufacturing a liquid ejection head in the related art.
Figure 1D:
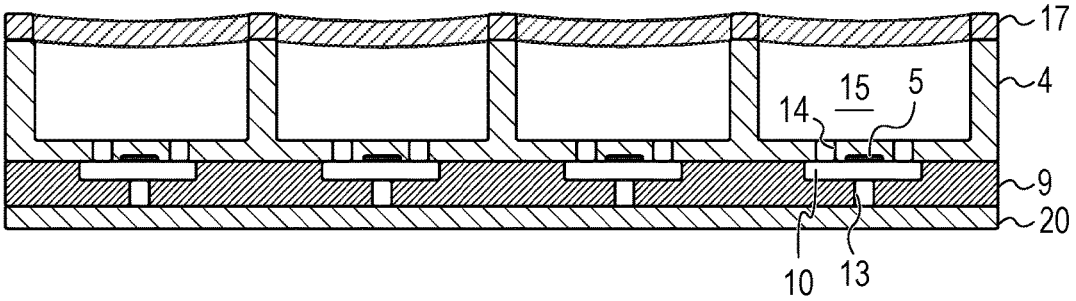
FIG. 1D is a view for illustrating a step of manufacturing a liquid ejection head in the related art.
Figure 2A:
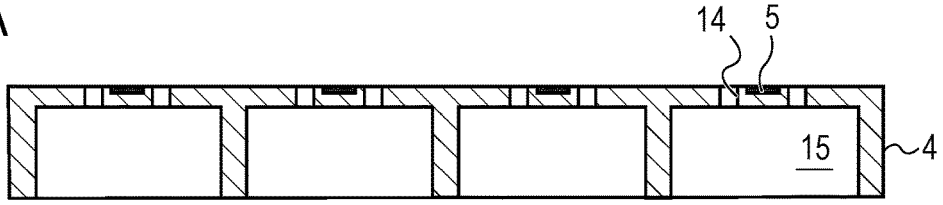
FIG. 2A is a view for illustrating steps of manufacturing a substrate to be used in a liquid ejection head according to an embodiment of the present invention.

First, as illustrated in FIG. 2A, a substrate 4 having energy generating elements 5 arranged on a first surface side is prepared, and supply ports 14 for supplying ink to the substrate 4 and supply ports 15 are formed by etching or the like. As the substrate 4, there is given, for example, a silicon substrate. As the etching, for example, dry etching such as reaction ion etching (RIE) and wet etching using tetramethyl ammonium hydroxide (TMAH), potassium hydroxide (KOH), or the like can be used. In FIG. 2A to FIG. 2G, the supply ports 15 are used as common liquid chambers, and the supply ports 14 are used as individual liquid chambers. Each of the supply ports 15 is opened to a second surface on a side opposite to the first surface of the substrate 4. As a method of forming the supply ports 14 and the supply ports 15, there is also given processing by laser ablation or sandblasting. As the energy generating elements 5, for example, electrothermal conversion elements or piezoelectric elements can be used. When the electrothermal conversion elements are used, ejection energy for causing a state change in a liquid is generated when the electrothermal conversion elements heat the liquid in the vicinity thereof. Further, a film called a passivation film may be formed as a film for protecting the energy generating elements 5.

Figure 2B:
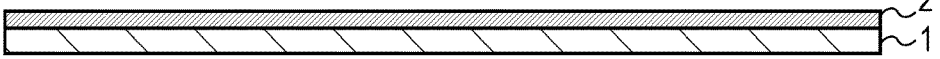
FIG. 2B is a view for illustrating a step of manufacturing a substrate to be used in a liquid ejection head according to an embodiment of the present invention.

After that, as illustrated in FIG. 2B, a resin (for example, an epoxy resin) to be a first photosensitive resin 2 is formed on a PET film that is a support 1. In this forming step, for example, a solution in which a photopolymerization initiator having sensitivity to an exposure wavelength of 365 nm at a time of forming an ink flow path pattern is dissolved in a solvent is applied to be laminated on the support 1 by slit coating. Regarding the dropping amount of the photopolymerization initiator, the sensitivity thereof is adjusted so that the first photosensitive resin 2 and a second photosensitive resin 9 to be an ejection orifice member are selectively exposed to light to be patterned.

It is preferred that the first photosensitive resin 2 be formed so as to have a thickness of from 5 μm to 30 μm. In association with this, it is preferred that the solution in which the first photosensitive resin 2 is dissolved in the solvent have a viscosity of from 5 cP to 150 cP. In the solution, it is preferred to use at least one solvent selected from the group consisting of propylene glycol methyl ether acetate (PGMEA), cyclohexanone, methyl ethyl ketone, and xylene.

In addition, the first photosensitive resin 2 is preferably a resin soluble in an organic solvent, such as an epoxy resin, an acrylic resin, or a urethane resin. Examples of the epoxy resin include a bisphenol A-type epoxy resin, a cresol novolac-type epoxy resin, and a circulation epoxy resin. An example of the acrylic resin is polymethyl methacrylate. An example of the urethane resin is polyurethane.

Examples of the support 1 include a film, glass, and a silicon wafer. Of those, in consideration of the fact that the support 1 is peeled afterward, a film is preferred. Examples of the film include a polyethylene terephthalate (PET) film, a polyimide film, and a polyamide (aramid) film. In addition, the support 1 may be subjected to release treatment so that the support 1 is easily peeled.

Figure 2C:
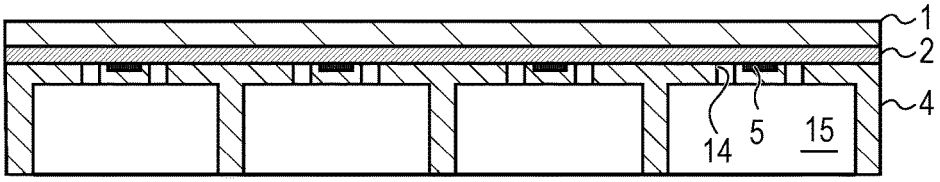
FIG. 2C is a view for illustrating a step of manufacturing a substrate to be used in a liquid ejection head according to an embodiment of the present invention.

Then, as illustrated in FIG. 2C, the first photosensitive resin 2 formed on the support 1 is inverted, and grounded on the first surface of the substrate 4 including the energy generating elements 5 so that the first photosensitive resin 2 straddles the supply ports 14. A temperature exceeding the softening point of the first photosensitive resin 2 and a pressure that deforms the first photosensitive resin 2 are applied to the first photosensitive resin 2 under a state in which the first photosensitive resin 2 is grounded on the substrate 4 through the support 1. Thus, the first photosensitive resin 2 is joined to the substrate 4 so that the first photosensitive resin 2 is released to parts of grooves of the supply ports 14. With this, the first photosensitive resin 2 can be formed so as to have thicknesses different between regions on the substrate 4 and regions on the grooves of the supply ports 14.

The thickness of the first photosensitive resin 2 on the substrate 4 corresponds to the height of an ink flow path, and hence it is preferred that the first photosensitive resin 2 be formed to a thickness of from 5 μm to 25 μm.

It is preferred that the thickness of the first photosensitive resin 2 on each of the grooves of the supply ports 14 be set so that the first photosensitive resin 2 has strength to breakage when the support 1 is peeled. For this purpose, it is preferred that the thickness of the first photosensitive resin 2 on each of the grooves of the supply ports 14 be larger than that on the substrate 4. When the first photosensitive resin 2 enters a part of the groove of the supply port 14, the first photosensitive resin 2 closely adheres to a side wall of the supply port 14 and hence is less liable to be broken. Further, as a method of causing the first photosensitive resin 2 to be grounded on the substrate 4, there is a method of transferring the first photosensitive resin 2 onto the substrate 4 by a lamination method or the like. It is preferred that the first photosensitive resin 2 be transferred onto the substrate 4 by a roll system or under vacuum in consideration of the discharging property of air bubbles during transfer. For example, the first photosensitive resin 2 is joined to the substrate 4 by a roll-type laminator. After that, the support 1 is peeled. An ink flow path is to be formed so as to straddle the supply ports 14, and hence it is preferred that the first photosensitive resin 2 have high mechanical strength and ink resistance as a material.

Figure 2D:
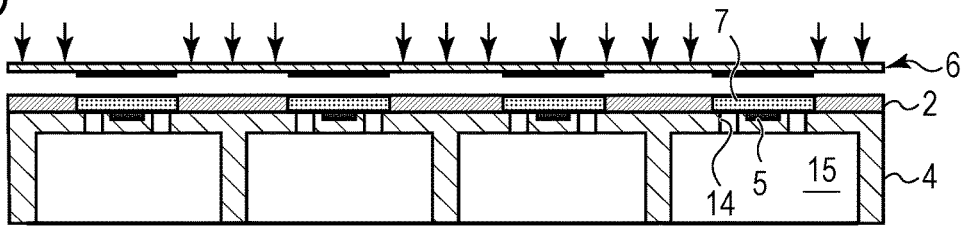
FIG. 2D is a view for illustrating a step of manufacturing a substrate to be used in a liquid ejection head according to an embodiment of the present invention.

After that, as illustrated in FIG. 2D, the first photosensitive resin 2 is partially irradiated with light through use of a mask 6 to form an ink flow path pattern. When the ink flow path pattern is formed, it is preferred that photolithography be used in order to establish the positional relationship between the ejection orifice 13 and the energy generating element 5 with satisfactory accuracy. A latent image is formed by irradiation with light so that each of unexposed portions 7 of the first photosensitive resin 2 forms an ink flow path.

Figure 2E:
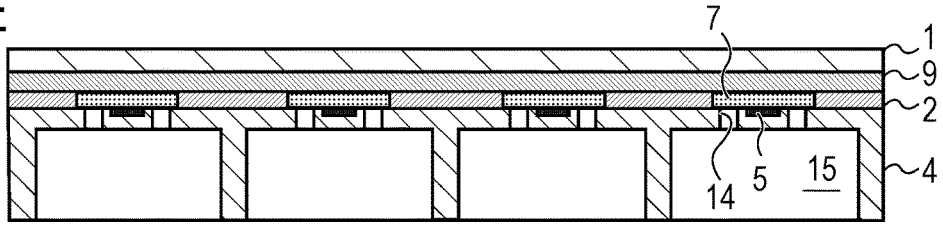
FIG. 2E is a view for illustrating a step of manufacturing a substrate to be used in a liquid ejection head according to an embodiment of the present invention.

Then, as illustrated in FIG. 2E, a second photosensitive resin 9 formed on the support 1 is transferred onto the first photosensitive resin 2 that forms the ink flow path pattern. The second photosensitive resin 9 is formed on the first surface of the substrate 4 in the same manner as in the first photosensitive resin 2. As a method of forming those lamination films on the first photosensitive resin 2 that forms an ink flow path wall, there are given coating by spin coating or slit coating, a lamination method, and a press method.

Figure 2F:
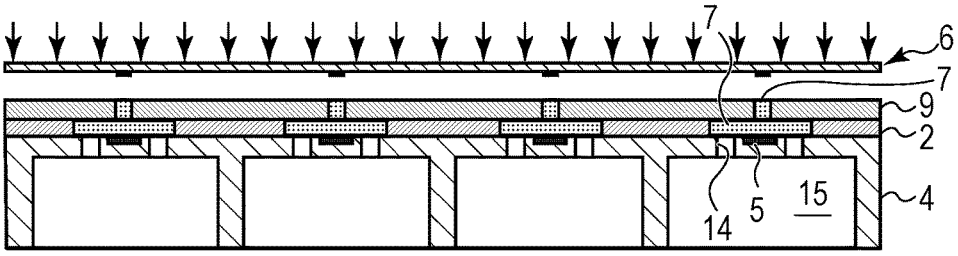
FIG. 2F is a view for illustrating a step of manufacturing a substrate to be used in a liquid ejection head according to an embodiment of the present invention.
Figure 2G:
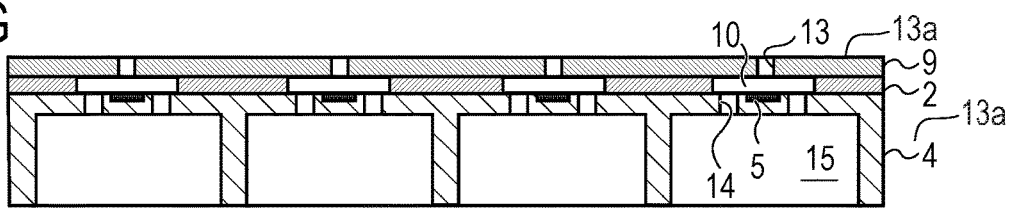
FIG. 2G is a view for illustrating a step of manufacturing a substrate to be used in a liquid ejection head according to an embodiment of the present invention.

After that, as illustrated in FIG. 2F, the support 1 is peeled, and the second photosensitive resin 9 is partially irradiated with light to be exposed to light through use of the mask 6 so that the unexposed portions 7 form the ejection orifices 13. Then, as illustrated in FIG. 2G, the first photosensitive resin 2 and the second photosensitive resin 9 are immersed in a developer to remove the unexposed portions 7, and thus the ejection orifices 13 and ink flow paths 10 are formed. It is preferred that, as the developer, at least one solvent selected from the group consisting of propylene glycol methyl ether acetate (PGMEA), tetrahydrofuran, cyclohexanone, methyl ethyl ketone, and xylene be used. The ejection orifice 13 and the supply port 15 communicate to each other in the substrate 4 through the supply ports 14 and the ink flow path 10. The second photosensitive resin 9 having the ejection orifices 13 opened therein serves as an ejection orifice member forming the ejection orifices 13.

FIG. 3A to FIG. 3F are views for illustrating steps of manufacturing a liquid ejection head 16, which are performed after the substrate is prepared in the steps of manufacturing the substrate illustrated in FIG. 2A to FIG. 2G. Now, a method of manufacturing the liquid ejection head 16 is described in the order of steps with reference to FIG. 3A to FIG. 3F.

Figure 3A:
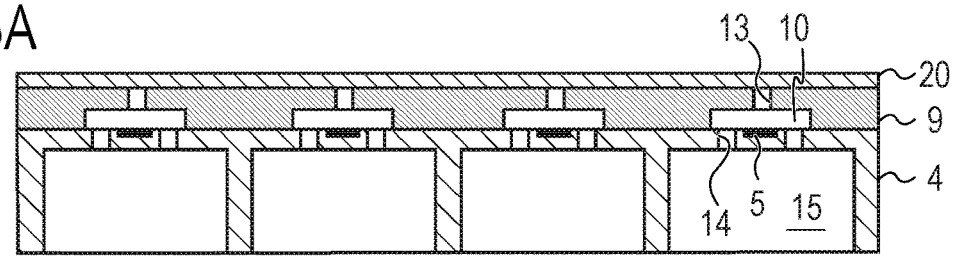
FIG. 3A is a view for illustrating step of manufacturing a liquid ejection head according to the embodiment of the present invention.

When the substrate 4 is completed as illustrated in FIG. 2G, a film 20 for protecting the ejection orifice surface 13*a* in which the ejection orifices 13 are formed of the substrate 4 is formed on the ejection orifice surface 13*a* in which the ejection orifices 13 are formed by transfer as illustrated in FIG. 3A. As a transfer method, there are given coating by spin coating or slit coating, a lamination method, and a press method. As a material for the film 20, a film tape having tackiness containing, as a main component, polyethylene terephthalate (PET), polyimide, or polyamide can be used. Through formation of the film 20 as described above, the ejection orifice surface 13*a* can be protected from the developer and the like in a back-end process.

When a flow path member is formed on openings of the supply ports 15 on the second surface through use of a dry film 17 described later, in the case where the dry film 17 is transferred onto the substrate 4, each space including the supply port 15 is sealed. When a pressure is changed in each sealed space, concave portions and deformation occur in the dry film 17.

In view of the foregoing, in the first embodiment, after the film 20 is transferred onto the ejection orifice surface 13*a*, communicating holes 21 are formed in the film 20 so that the ejection orifices 13 communicate to outside. With this, each space including the supply port 15 is not sealed in the back-end process, and the occurrence of the concave portions and deformation in the dry film 17 can be suppressed.

Figure 3B:
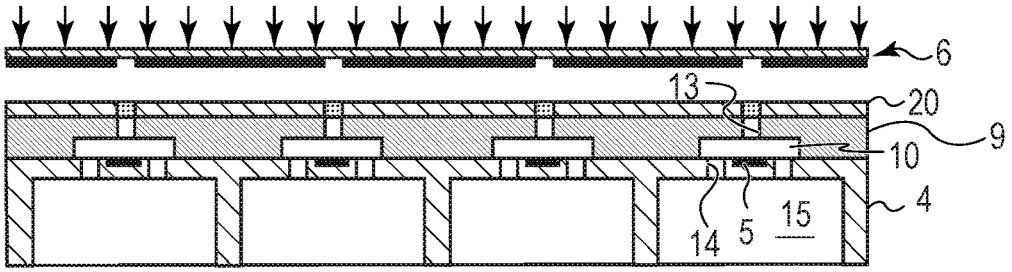
FIG. 3B is a view for illustrating a step of manufacturing a liquid ejection head according to the embodiment of the present invention.
Figure 3C:
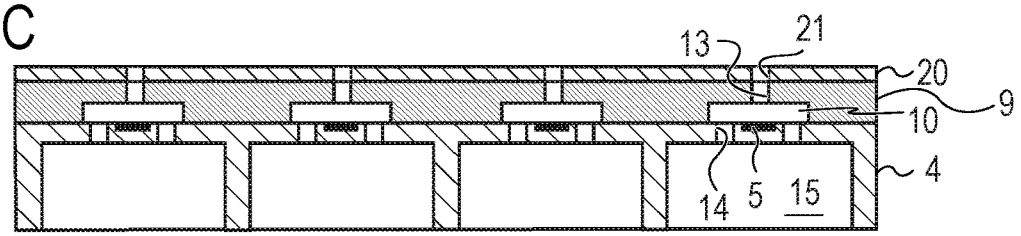
FIG. 3C is a view for illustrating a step of manufacturing a liquid ejection head according to the embodiment of the present invention.

First, as illustrated in FIG. 3B, in order to establish the positional relationship with respect to the ejection orifices 13 with satisfactory accuracy, a pattern for forming communicating holes is formed through use of a photolithography technology. After that, as illustrated in FIG. 3C, the resultant is immersed in a developer to remove portions corresponding to communicating holes of the film 20, to thereby form the communicating holes 21 for allowing the ejection orifices 13 to communicate to outside. The communicating holes 21 can be formed also into a round shape, an elliptic shape, a polygonal shape, or an irregular shape as long as the communicating holes 21 have a shape and a size capable of allowing the ejection orifices 13 to communicate to outside. The communicating holes 21 may be formed by irradiation with a laser.

Figure 3D:
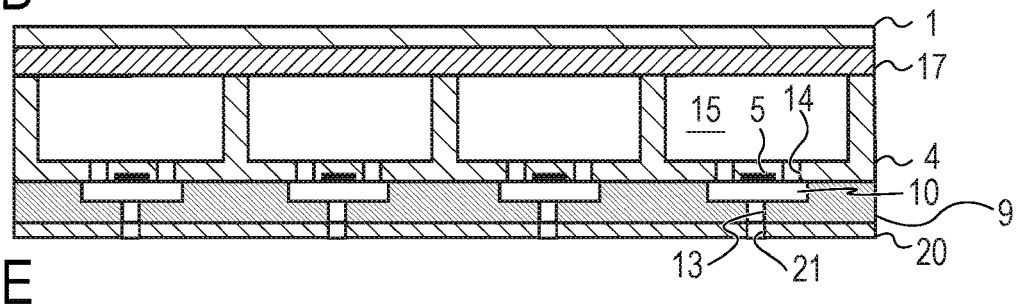
FIG. 3D is a view for illustrating a step of manufacturing a liquid ejection head according to the embodiment of the present invention.

After that, as illustrated in FIG. 3D, the dry film 17 to be a flow path member 18 having flow path manifolds for supplying ink to the supply ports 15 is formed. The openings of the supply ports 15 on the second surface are closed by forming the dry film 17 on the supply ports 15. As a method of forming the dry film 17, there is a method of transferring the dry film 17 formed on the support 1 onto the substrate 4 by a lamination method. It is preferred that the dry film 17 be transferred onto the substrate 4 by a roll system or under vacuum in consideration of the discharging property of air bubbles during transfer. Thus, the dry film 17 forms the flow path member 18 so that the flow path member 18 straddles the supply ports 15, and hence the dry film 17 is required to have high mechanical strength and ink resistance as a material. In this respect, it is preferred that the dry film 17 be made of, for example, a photosensitive resin, in particular, a chemically amplified negative photosensitive resin containing a photoacid generator. It is preferred that the support 1 be formed of, for example, PET, polyimide, or a hydrocarbon-based film.

Figure 3E:
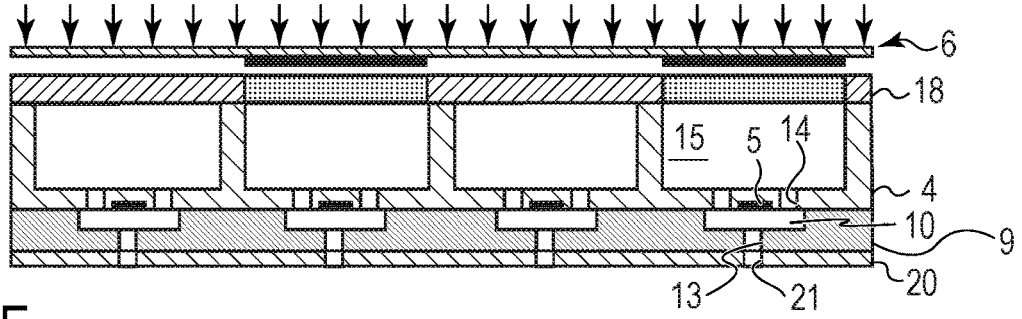
FIG. 3E is a view for illustrating a step of manufacturing a liquid ejection head according to the embodiment of the present invention.

As described above, the dry film 17 is patterned under a state in which the film 20 having the communicating holes 21 is formed on the ejection orifice surface 13*a*. The PET film that is the support 1 is peeled, and the dry film 17 is irradiated with light to be exposed to light through use of the mask 6 as illustrated in FIG. 3E so that exposed portions of the dry film 17 form the flow path member 18.

Figure 3F:
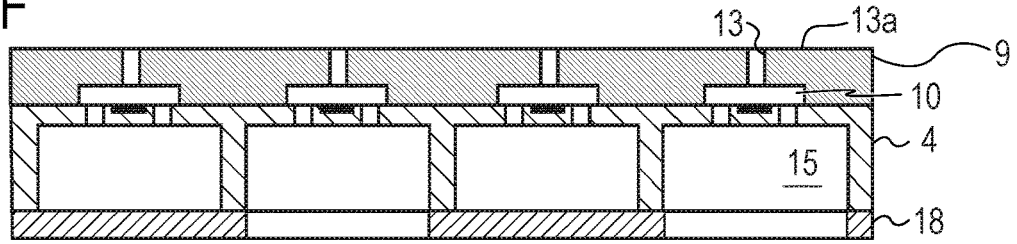
FIG. 3F is a view for illustrating a step of manufacturing a liquid ejection head according to the embodiment of the present invention.

After that, as illustrated in FIG. 3F, the resultant is immersed in a developer to form the flow path member 18. It is preferred that, as the developer, at least one solvent selected from the group consisting of propylene glycol methyl ether acetate (PGMEA), tetrahydrofuran, cyclohexanone, methyl ethyl ketone, and xylene be used. After that, the resultant is immersed in a peeling liquid to peel the film 20 for protecting the ejection orifice surface 13*a*. Then, exposure of full irradiation is performed as second exposure by an exposure apparatus, and further, curing is performed.

Figure 4:
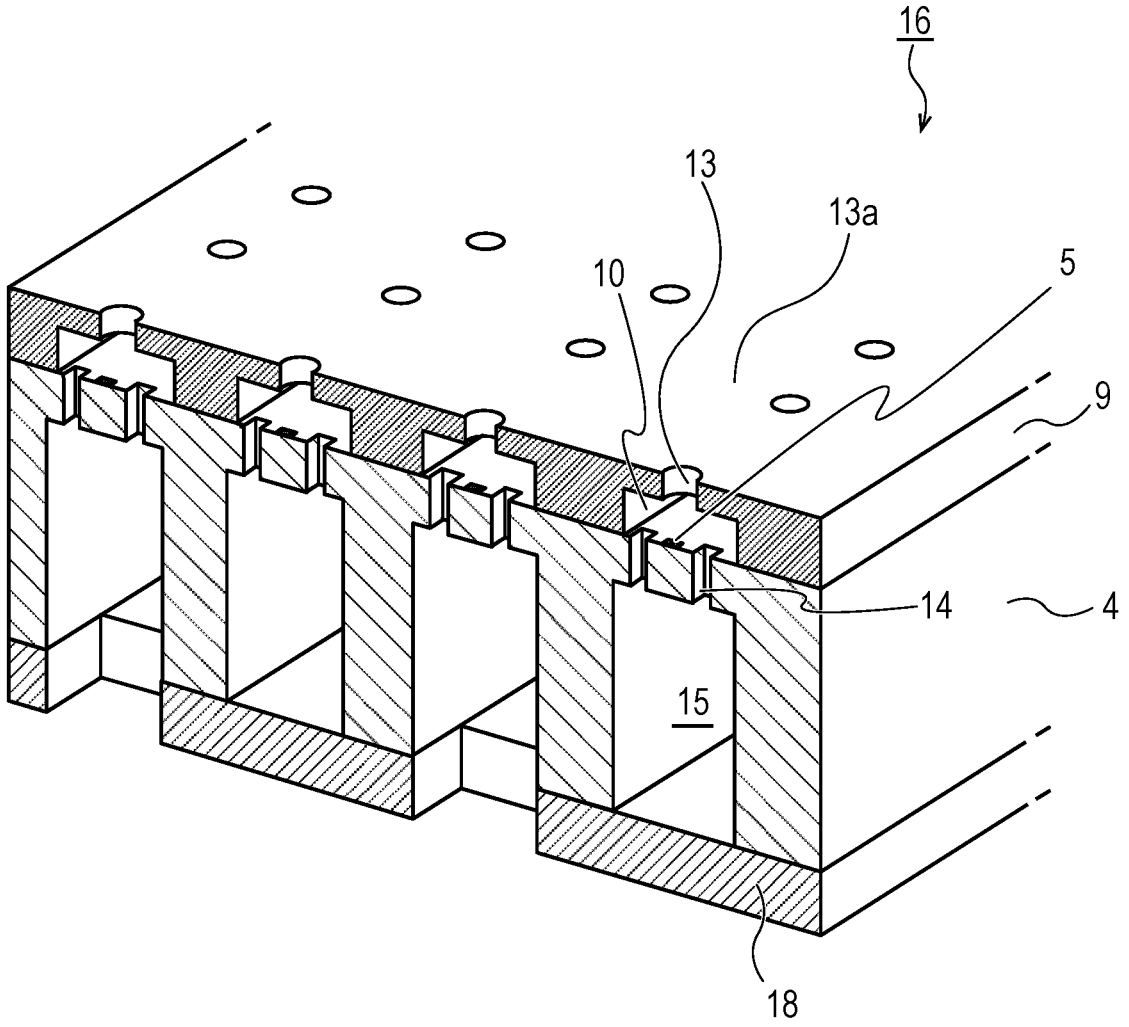
FIG. 4 is a perspective view for illustrating the liquid ejection head according to the embodiment of the present invention.

FIG. 4 is a perspective view of the liquid ejection head 16 in the first embodiment. The recording head formed as described above is subjected to electrical bonding of electric wiring members configured to drive electrothermal conversion elements. With this, the liquid ejection head 16 having a shape as illustrated in FIG. 4 can be manufactured.

As described above, the communicating holes for allowing the ejection orifices to communicate to outside are formed in the film for protecting, in particular, the ejection orifice surface 13*a* of the ejection orifice member. With this, a method of manufacturing a liquid ejection head capable of patterning a dry film while suppressing deformation of the dry film caused by a pressure can be provided.

Second Embodiment

Now, a second embodiment of the present invention is described with reference to the drawings. The basic configurations of the second embodiment are the same as those of the first embodiment, and hence only characteristic configurations are described below.

Figure 5:
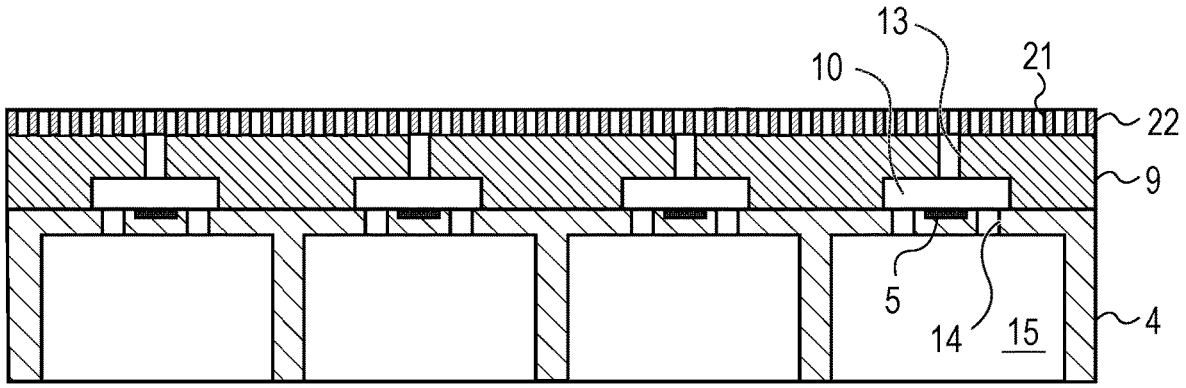
FIG. 5 is a view for illustrating a part of steps of manufacturing a liquid ejection head according to an embodiment of the present invention.

FIG. 5 is a view for illustrating a part of steps of manufacturing a liquid ejection head according to the second embodiment under a state in which a protection tape 22 is bonded as a film to the ejection orifice surface 13*a* in which the ejection orifices 13 are formed. The protection tape 22 in the second embodiment is a tape including a plurality of the communicating holes 21, and the ejection orifices 13 communicate to outside under a state in which the protection tape 22 is bonded to the ejection orifice surface 13*a*.

As described above, the tape for protecting the ejection orifice member is used as the protection tape including the communicating holes. With this, a method of manufacturing a liquid ejection head capable of patterning a dry film while suppressing deformation of the dry film caused by a pressure can be provided.

Example

Now, the present invention is specifically described by way of an Example.

First, as illustrated in FIG. 2A, the substrate 4 having the energy generating elements 5 arranged thereon was prepared, and the supply ports 14 and the supply ports 15 were formed in the substrate 4 by dry etching such as RIE. As the substrate 4, a silicon substrate made of a single crystal of silicon was used. As the energy generating elements 5, electrothermal conversion elements made of TaSiN were used. A surface of the substrate 4 on which the energy generating elements 5 are arranged corresponds to the first surface, and a surface on a side opposite to the first surface, on which the supply ports 15 are opened, corresponds to the second surface.

After that, as illustrated in FIG. 2B, an epoxy resin (N-695 manufactured by DIC Corporation) to be the first photosensitive resin 2 was formed on the PET film being the support 1. In this forming step, a solution in which a photopolymerization initiator (CPI-210S manufactured by San-Apro Ltd.) having sensitivity to an exposure wavelength of 365 nm at a time of forming an ink flow path pattern was dissolved in a solvent (for example, PGMEA) was applied to be laminated on the support 1 by slit coating. The thickness of the first photosensitive resin 2 was set to 16 μm. The viscosity of the solution in which the first photosensitive resin 2 was dissolved in the solvent was set to 100 cP. As the solution, propylene glycol methyl ether acetate (PGMEA) was used. As the first photosensitive resin 2, a bisphenol A-type epoxy resin was used.

As the support 1, a polyethylene terephthalate (PET) film subjected to release treatment was used.

As illustrated in FIG. 2C, the first photosensitive resin 2 formed on the support 1 was inverted and grounded on the first surface of the substrate 4 including the energy generating elements 5 so that the first photosensitive resin 2 straddled the supply ports 14. The first photosensitive resin 2 was joined to the substrate 4 so that the first photosensitive resin 2 was released to parts of the grooves of the supply ports 14 under a state in which the first photosensitive resin 2 was grounded on the substrate 4 through the support 1. With this, the first photosensitive resin 2 had thicknesses different between regions on the substrate 4 and regions on the grooves of the supply ports 14. When the first photosensitive resin 2 was grounded on the substrate 4, the first photosensitive resin 2 was joined to the substrate 4 with a roll-type laminator (VTM-200 manufactured by Takatori Corporation) under conditions of a temperature of 90° C. and a pressure of 0.4 MPa so that the thickness of the first photosensitive resin 2 on the substrate 4 reached 15 μm. Then, the support 1 was peeled at 25° C.

After that, as illustrated in FIG. 2D, the first photosensitive resin 2 was partially irradiated with light through use of the mask 6 to form the ink flow path pattern.

In order to form the ink flow path pattern, pattern exposure was performed through the mask 6 through use of light having an exposure wavelength of 365 nm at an exposure amount of 5,000 J/m$^2$ by an exposure apparatus (FPA-3000i5+ manufactured by Canon Inc.). Then, post exposure bake (hereinafter referred to as "PEB") was performed at 50° C. for 5 minutes to form a latent image so that the unexposed portions 7 of the first photosensitive resin 2 formed ink flow paths.

Then, as illustrated in FIG. 2E, the second photosensitive resin 9 formed on the support 1 was transferred onto the first photosensitive resin 2 to be the ink flow path pattern on the first surface of the substrate 4 by a lamination method.

After that, as illustrated in FIG. 2F, the support 1 was peeled, and the second photosensitive resin 9 was partially irradiated with light to be exposed to light through use of the mask 6 so that the unexposed portions 7 formed the ejection orifices 13. Then, as illustrated in FIG. 2G, the first photosensitive resin 2 and the second photosensitive resin 9 were immersed in a developer to remove the unexposed portions 7, and thus the ejection orifices 13 and the ink flow paths 10 were formed. As the developer, propylene glycol methyl ether acetate (PGMEA) was used. Thus, the second photosensitive resin 9 was formed into an ejection orifice member forming the ejection orifices.

When the substrate 4 was completed as illustrated in FIG. 2G, the film 20 for protecting the ejection orifice surface 13*a* in which the ejection orifices 13 were formed of the substrate 4 was formed on the surface in which the ejection orifices 13 were formed by a lamination method as illustrated in FIG. 3A. As the material for the film 20, a film tape containing a negative photosensitive resin as a main component was used.

After the film 20 was formed on the ejection orifice surface 13*a*, the communicating holes 21 were formed in the film 20 so that the ejection orifices 13 communicated to outside. Specifically, as illustrated in FIG. 3B, pattern exposure was performed through the mask 6 through use of light having an exposure wavelength of 365 nm at an exposure amount of 1,000 J/m$^2$ by an exposure apparatus (projection exposure apparatus manufactured by Ushio Inc.). After that, as illustrated in FIG. 3C, the resultant was immersed in a developer to remove portions corresponding to the communicating holes of the film 20, to thereby form the communicating holes 21 for allowing the ejection orifices 13 to communicate to outside.

After that, as illustrated in FIG. 3D, the dry film 17 to be the flow path member 18 having flow path manifolds for supplying ink to the supply ports 15 was formed. The dry film 17 formed on the support 1 was transferred onto the substrate 4 by a lamination method. The transfer was performed by a roll system under vacuum. Thus, the supply ports 15 were closed with the dry film 17. As the dry film 17, a chemically amplified negative photosensitive resin containing a photoacid generator was used. As the support 1, a PET film was used.

Next, the dry film 17 was patterned. The PET film being the support 1 was peeled, and the dry film 17 was irradiated with light to be exposed to light through use of the mask 6 as illustrated in FIG. 3E so that exposed portions of the dry film 17 formed the flow path member 18. Specifically, pattern exposure was performed as first exposure through the mask 6 through use of light having an exposure wavelength of 365 nm at an exposure amount of 400 mJ/m$^2$ by an exposure apparatus (projection exposure apparatus manufactured by Ushio Inc.).

After that, as illustrated in FIG. 3F, the resultant was immersed in propylene glycol methyl ether acetate (PGMEA) as a developer to form the flow path member 18.

After that, the resultant was immersed in a peeling liquid to peel the film 20 for protecting the ejection orifice surface 13*a*. Then, exposure of full irradiation was performed as second exposure at an exposure amount of 2,000 mJ/cm$^2$ by an i-beam exposure apparatus, and curing was performed at 200° C. for 1 hour.

FIG. 4 is a view for illustrating the liquid ejection head 16 in this Example. The recording head formed as described above was subjected to electrical bonding of electric wiring members configured to drive electrothermal conversion elements. With this, the liquid ejection head having a shape as illustrated in FIG. 4 was able to be manufactured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-176014, filed Sep. 13, 2017, which is hereby incorporated by reference herein in its entirety.

What is claimed is:

1. A method of manufacturing a liquid ejection head, the liquid ejection head including a substrate and an ejection orifice member, which is formed on a first surface of the substrate, and has an ejection orifice surface having formed therein ejection orifices, the method comprising:

preparing the substrate including, on the first surface, the ejection orifice member having the ejection orifice surface having formed therein the ejection orifices, and a supply port opened on a second surface on a side opposite to the first surface of the substrate, the ejection orifices and the supply port communicating with each other in the substrate;

forming, on the ejection orifice surface, a film having communicating holes for allowing the ejection orifices to communicate to outside;

closing an opening of the supply port on the second surface with a dry film; and forming a flow path member by patterning the dry film by irradiating the dry film with light, wherein, in the forming of the flow path member, the film having the communicating holes is present on the ejection orifice surface.

2. The method according to claim 1, further comprising forming the communicating holes in the film.

3. The method according to claim 2, wherein the forming of the communicating holes is carried out by irradiating the film with a laser.

4. The method according to claim 1, wherein the forming of the film on the ejection orifice surface is carried out by bonding a protection tape having communicating holes to the ejection orifice surface.

5. The method according to claim 2, wherein the forming of the communicating holes is carried out by irradiating portions of the film, in which the communication holes are to be formed, with light and immersing the film in a developer.

6. The method according to claim 1, wherein the film is made of polyethylene terephthalate.

7. The method according to claim 1, wherein the film is made of a negative photosensitive resin.

8. The method according to claim 1, wherein the ejection orifice member is made of a photosensitive resin.

9. The method according to claim 1, wherein the closing of the opening of the supply port on the second surface with the dry film is carried out by transferring the dry film onto the second surface of the substrate by a lamination method.

10. The method according to claim 1, wherein the dry film is made of a photosensitive resin.

11. The method according to claim 10, wherein the dry film is made of a negative photosensitive resin.

12. The method according to claim 1, wherein the forming of the flow path member comprises immersing the dry film irradiated with light in a developer.

13. The method according to claim 1, further comprising peeling the film after the forming of the flow path member.

14. The method according to claim 13, wherein the peeling of the film is carried out by immersing the film in a peeling liquid.

* * * * *